US007992225B2

(12) United States Patent
Demus

(10) Patent No.: US 7,992,225 B2
(45) Date of Patent: Aug. 9, 2011

(54) I-POCKET FOR A GARMENT

(76) Inventor: Roderick Lee Demus, Dallas, TX (US)

( * ) Notice: Subject to any disclaimer, the term of this patent is extended or adjusted under 35 U.S.C. 154(b) by 295 days.

(21) Appl. No.: 11/369,213

(22) Filed: Mar. 6, 2006

(65) Prior Publication Data

US 2006/0206990 A1 Sep. 21, 2006

(51) Int. Cl.
*A41D 27/20* (2006.01)

(52) U.S. Cl. ..... 2/247

(58) Field of Classification Search ..... 2/247, 249–254, 2/69, 94, 108, 115
See application file for complete search history.

(56) References Cited

U.S. PATENT DOCUMENTS 4,825,471 A * 5/1989 Jennings ..... 2/94
4,876,724 A * 10/1989 Suzuki ..... 381/385
6,691,323 B2 * 2/2004 Widmer ..... 2/247
6,810,529 B1 * 11/2004 Reilly et al. ..... 2/69
6,826,782 B2 * 12/2004 Jordan ..... 2/94

* cited by examiner

*Primary Examiner* — Tejash Patel
(74) *Attorney, Agent, or Firm* — Delphine James

(57) ABSTRACT

The present invention is a securing pocket for attachment to a garment that supports a small hands-free electronic device. The pocket further comprises an opening within the garment for supporting the pocket. The opening is dimensioned and contoured to support the electronic device. The pocket further comprises a first covering and a second covering dimensioned and contoured to support the electronic device. The second covering overlays the first covering and have a seamless attachment thereto with an edge being left unattached for receiving and removing the electronic device. The first cover has slightly larger dimensions than the opening and overlays the opening and has a seamless attachment thereto.

7 Claims, 9 Drawing Sheets

Top View

Figure 9c
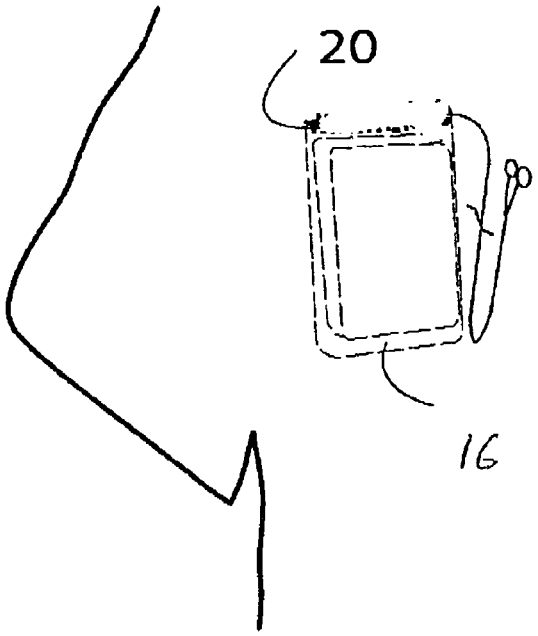
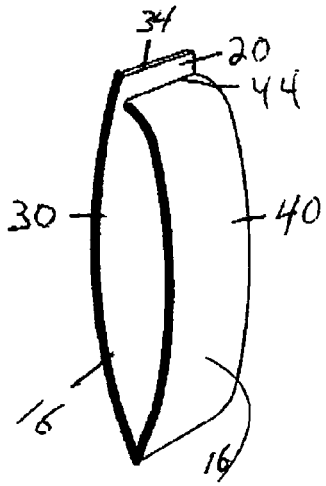
Figure 9 A
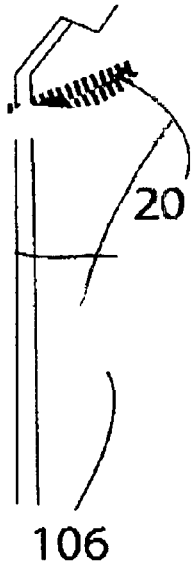
Figure 9 B

Figure 10c
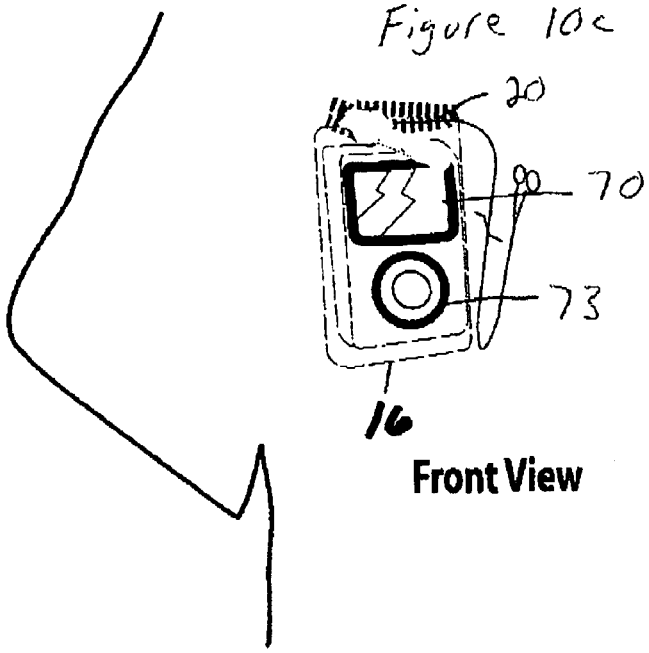
Front View
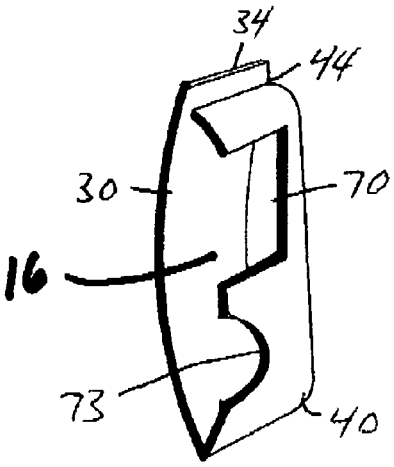
Pocket
Figure 10A
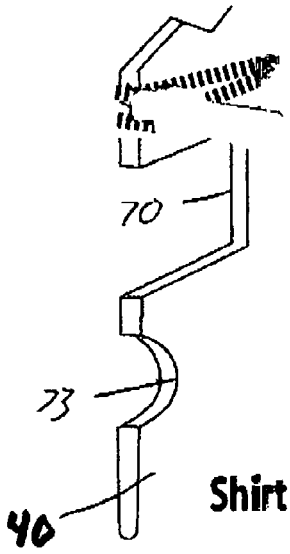
Shirt
Figure 10B

I-POCKET FOR A GARMENT

BACKGROUND

This invention relates to an article for securing a small hands free electronic sound recording device. More particularly this invention relates to a pocket for securing a hands free sound recording device. Exercise today is an important part of many people lives. While people exercise they like to listen to many devices such as radios, CD players, MP3 players and many other such sound recording devices. However while exercising securing a hand free device becomes a difficult task to manage. This invention was designed to alleviate this problem.

BRIEF DESCRIPTION OF DRAWINGS

FIG. 9A shows pocket lying behind base fabric 106 in FIG. 9B.

FIG. 9C shows device 10 within pocket container 107.

FIG. 10A shows alternative embodiment of pocket lying behind base fabric 106 in FIG. 10B.

FIG. 10C shows device 10 within pocket container 107.

DETAILED SPECIFICATION

Figure 1:
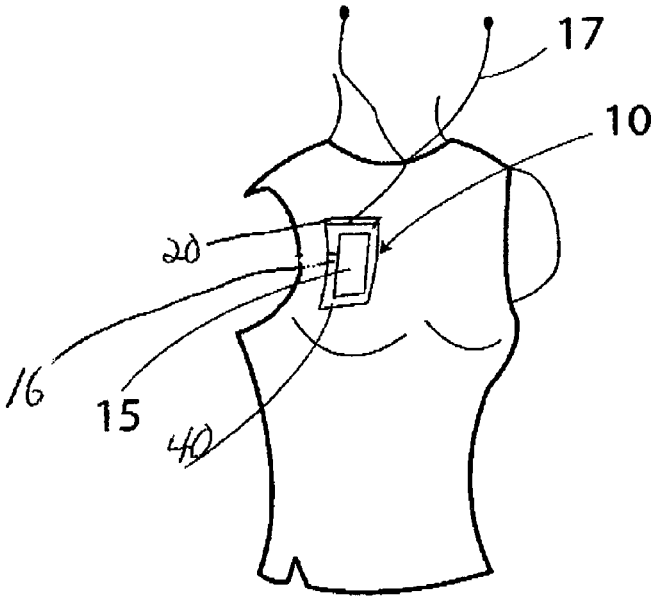
FIG. 1 is a frontal view of the present invention, pocket attached to a garment.

Referring to FIGS. 1-7, there is shown a securing pocket (10) for a small hands-free electronic device attached to a garment. Pocket (10) which is dimensioned to the size and shape of the small electronic device (15) further comprises opening (20), covering1 (30), and covering2 (40). As depicted in FIG. 1, for illustration only, the hands free device (15) is rectangular in shape. Thus, pocket (10) is also rectangular in shape. However, it is to be understood that the invention may assume various alternative orientations and step sequences, unless it is expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
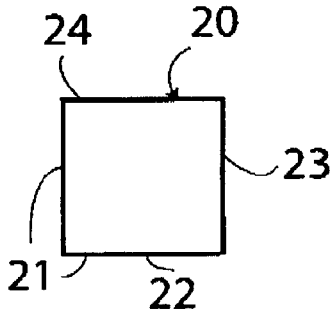
FIGS. 2-2B is an illustration of the garment opening, covering1, and covering2.
Figure 2A:
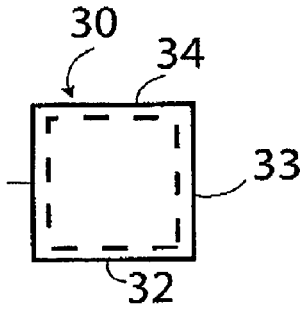
FIG. 2C is an illustration of the pocket cavity.
FIG. 2D is an illustration of top view of opening 20 onto base material 106.
Figure 2B:
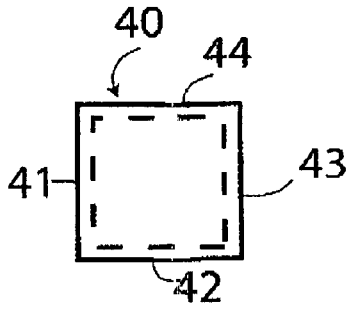
Figure 2D:
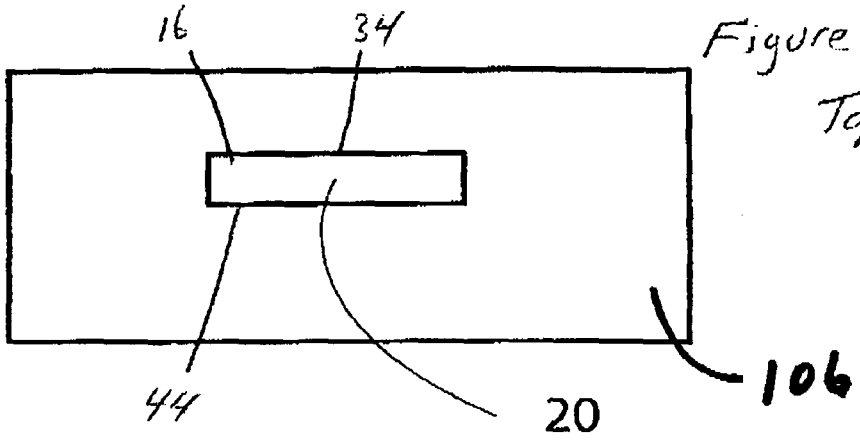
Figure 2C:
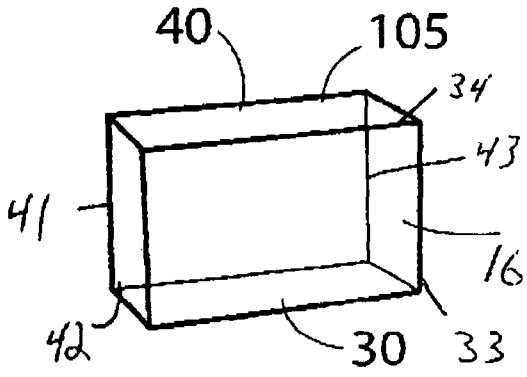
Figure 9:
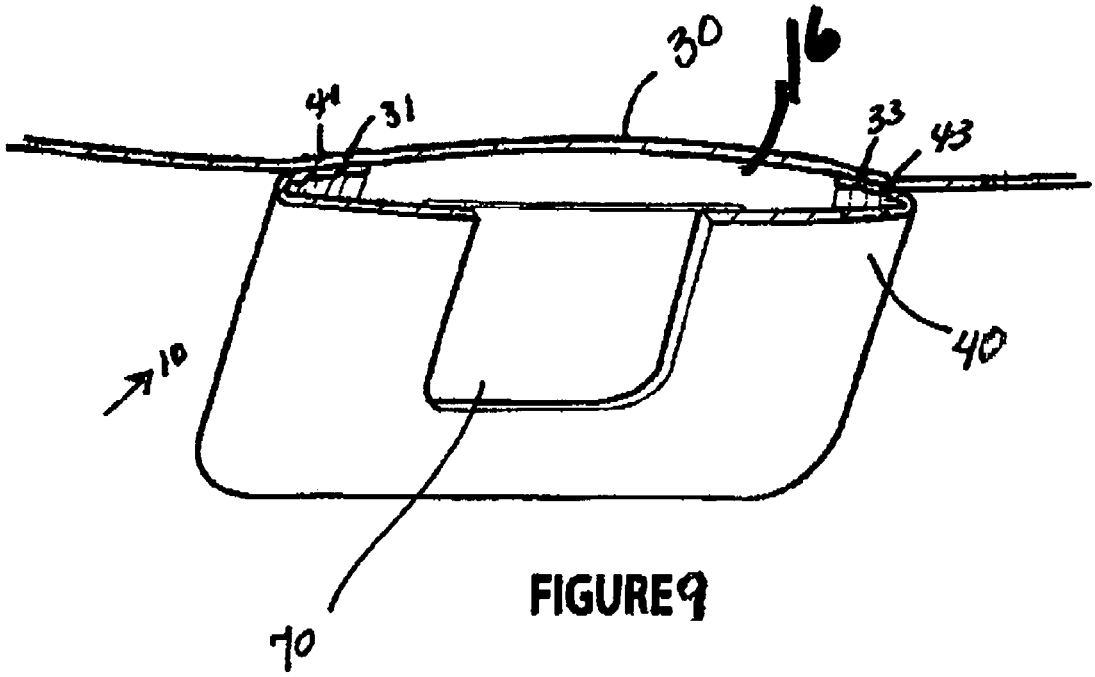
FIG. 9 is a cross-sectional view of the pocket showing the seamless connection.

Referring to FIG. 2, there is shown opening (20) which is rectangular in shape as device (10). A cutout is made onto and there through the base material (106) shown in FIG. 2D of the garment forming the top view of the perimeter of opening (20). Then, FIG. 2A illustrates covering1 (30) which directly attaches to opening (20). Finally, FIG. 2B illustrates covering2 (40) which overlays covering1 (30) as shown in FIG. 2C. Thus, to form cavity (16), edge1 (31), edge2 (32), and edge3 (33) of covering1 is secured to edge1 (41), edge2 (42), and edge3 (43) of covering2. Edge 34 and 44 are to the perimeter (105) of opening (20) into pocket cavity (16). Pocket cavity (16) is disposed behind opening 20 along the interior surface area of base material 106 and in a longitudinal direction with the secured edges of pocket cavity (16) detached from base material 106. To secure pocket cavity (16) to opening (20), peripheral edges of perimeter 20 is folded inward toward the chest area and the peripheral edges of perimeter opening (105) are folded inwardly toward the chest area. Folded peripheral edges 20 and pocket cavity 16 are overlaid with the outer peripheral edges abutting each other. Opening (20), covering1 (30), and covering2 (40) each further include edge1 (21, 31, 41), edge2 (22, 32, 42) edge3 (23, 33, 43) and edge4 (24, 34, 44). In order to attach covering1 (30) and covering2 (40) to opening (20), edge1 (41), edge2 (42), and edge3 (43) of covering2 (40) are overlaid onto edge1 (31), edge2 (32), edge3 (33) of covering1 (30). Both covering1 (30) and covering2 (40) are then attached to edge1 (21), edge2 (22), and edge3 (23) of opening (20) with the overlaid edges of covering1 (30) and covering2 (40) facing inwardly toward the chest area. Edge4 (34) of covering1 (30) is aligned with edge4 (24) of opening (20) such that the aligned edges facing inwardly toward the chest area. Edge4 (44) of covering2 (40) is aligned with edge4 (24) of opening (20) such that the aligned edges facing inwardly toward the chest area. Opening 20 provides the entry way into pocket cavity 16. Then the aligned edge4 (24, 34) of opening (20) and covering1 (30) are attached with the aligned edges facing inwardly toward the chest area. Edge4 (44) of the covering2 (40) is left unattached to allow for the insertion and removal of the device (15). FIG. 1 shows pocket (10) attached to the garment FIG. 9A shows pocket lying behind base fabric 106 in FIG. 9B. FIG. 9C shows device 10 within pocket cavity 16. FIG. 10A shows alternative embodiment of pocket lying behind base fabric 106 in FIG. 10B. FIG. 9 illustrates an alternative Cross-sectional View of the Pocket 10 attached to opening 20 illustrating window (70) cut within covering 40.

Figure 5:
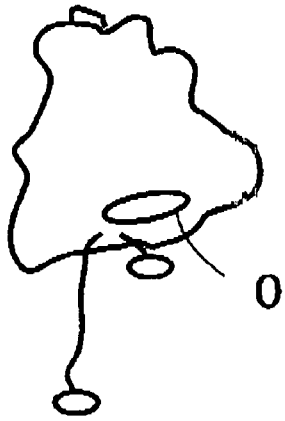
FIG. 5 is the pocket attached to a hat.
Figure 8:
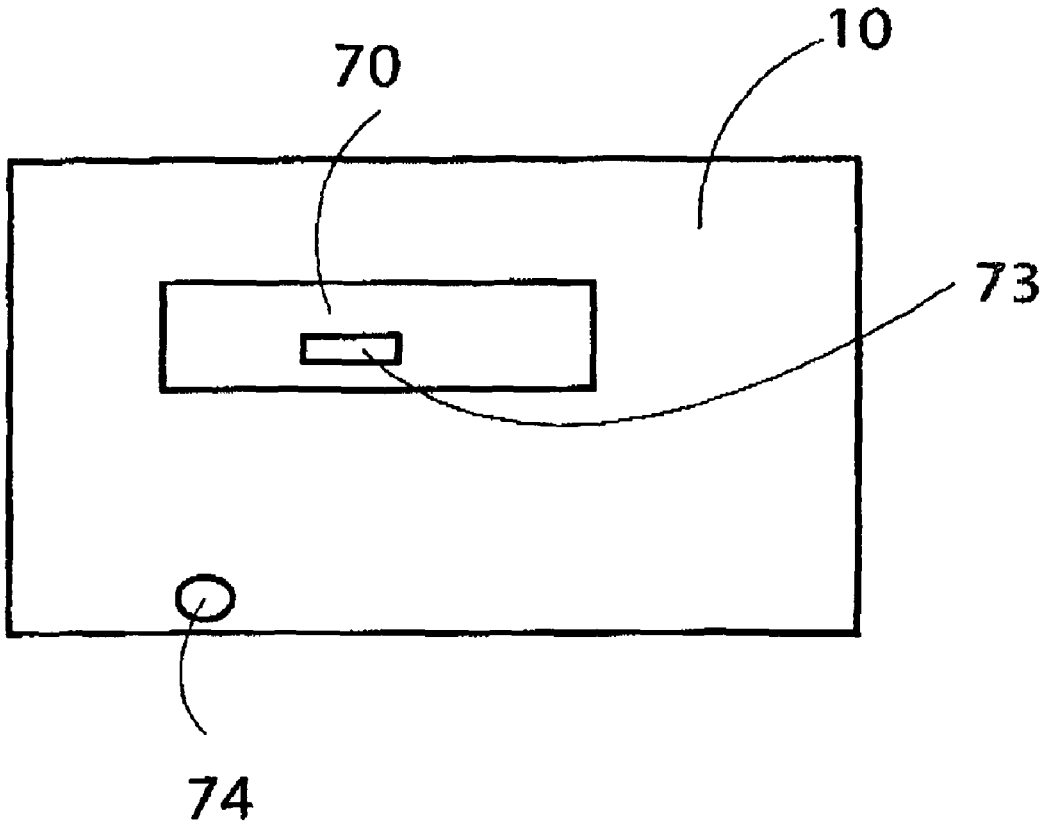
FIG. 8 is the pocket with support for the video display, control buttons, and the head jack.

As depicted in FIG. 5, pocket (10) can have a small capsule configuration. This configuration is particularly preferable for hats, caps, and other small garments as depicted in FIG. 8. Additionally, the peripheral edges of covering2 (40) can be attached directly to the garment along the pocket outline as depicted in FIG. 8.

Figure 3:
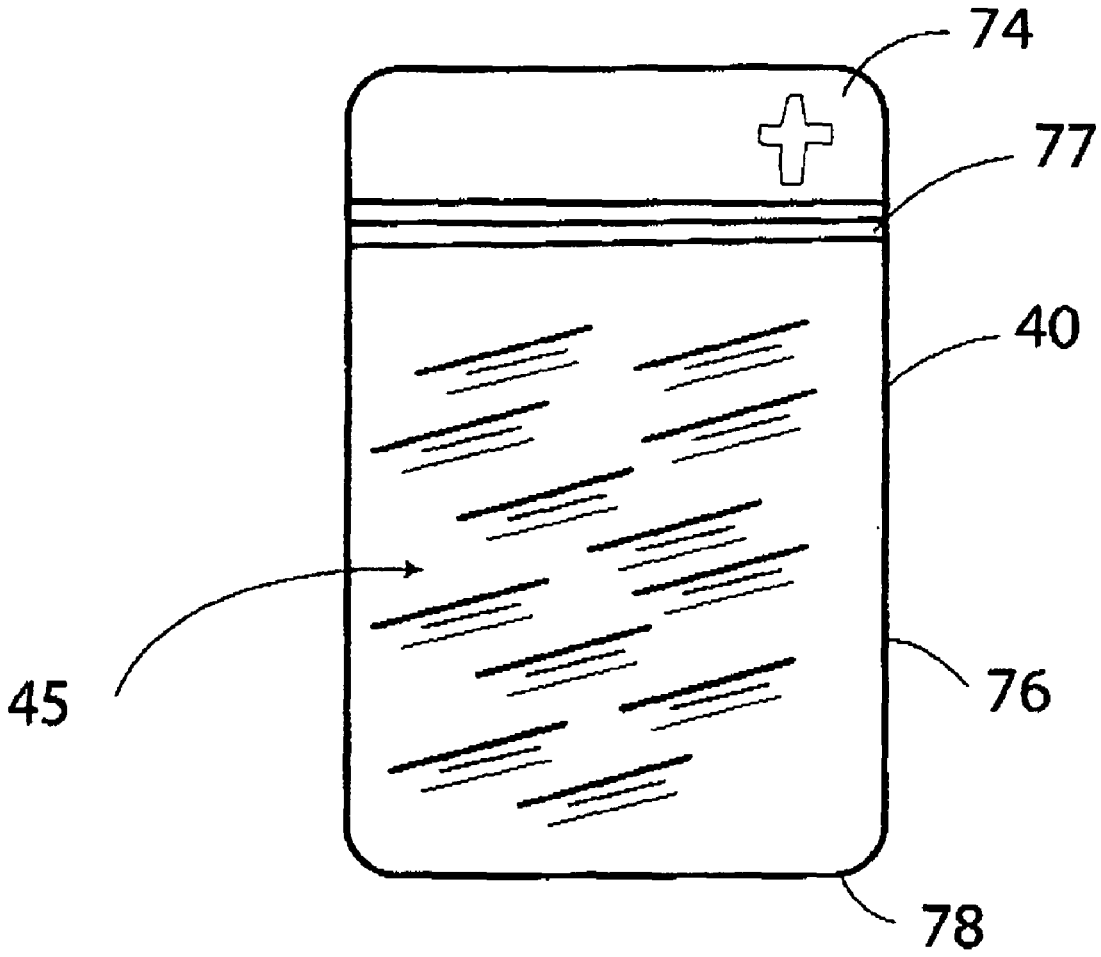
FIG. 3 is an internal surface area of covering2.

As depicted in FIG. 3, covering2 (40) can have an alternative embodiment. In this embodiment, covering2 (40) can further include upper flap1 (74) and lower flap2 (76). Upper flap1 (74) overlay lower flap2 (76) leaving opening (77) for entry of sound device into pocket (10). As described above, the peripheral edges of covering2 (40) are attached adjoined to the garment along pocket outline (not shown).

Covering1 (30) further comprises an interior surface and an exterior surface area. Additionally, the dimensions for covering1 (30) is slightly larger than opening (20). The slightly larger dimensions of covering1 (30) allows the exterior surface area of covering1 (30) to be pushed inwardly towards the chest area forming a cavity (16) for receiving the device (15) as shown in FIG. 1. When device (15) is placed inside the cavity (16), the interior surface are of covering1 (30) touches the body as depicted in FIG. 1. Covering1 (30) is preferably made from a breathable material which allows the sweat from the body not to affect the operation of the device (15).

Referring to FIG. 3, covering2 (40) further comprises an exterior surface area and an interior surface area. Fastening means is attached to the interior surface area of covering2

(40). Fastening means can cover the entire surface area, the peripheral edges of the interior surface area, or an elongated strip horizontally or vertically across the interior surface area. Fastening means (45) is pressed forward towards exterior surface area of covering1 (30). Fastening means (45) is adapted to securely and removeably attach to the exterior surface area of covering1 (30) as depicted in FIG. 1. Once fastening means (45) is pressed forward to securely attached to the exterior surface area of covering1 (30), the device is securely held in place in cavity (16). At this point, the pocket (10) provides a perfectly seamless look on the garment.

Fastening means (45) is preferable made of the type of Velcro that does not require a mating member to be attached to the exterior surface area of covering1 (30). However, the exterior surface area of covering1 (30) can have a mate member having equivalent dimensions of fastening means (45) for receiving fastening means (45). As depicted in FIG. 1, covering2 (40) can further comprise at least one aperture adapted to receive the ear phones wires of device (15) there through.

Figure 4:
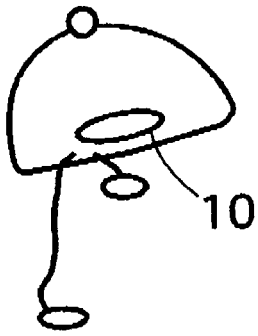
FIG. 4 is the pocket attached to a cap.
Figure 6:
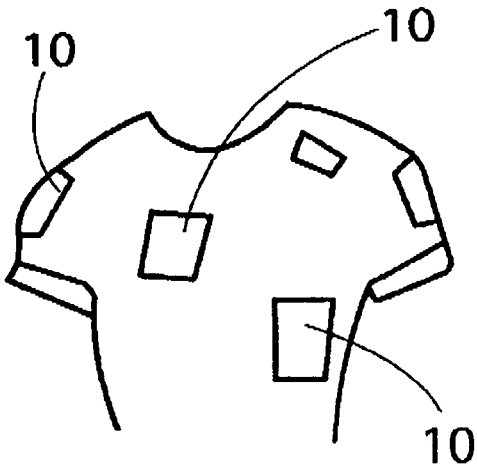
FIG. 6 is the pocket attached to a shirt.
Figure 7:
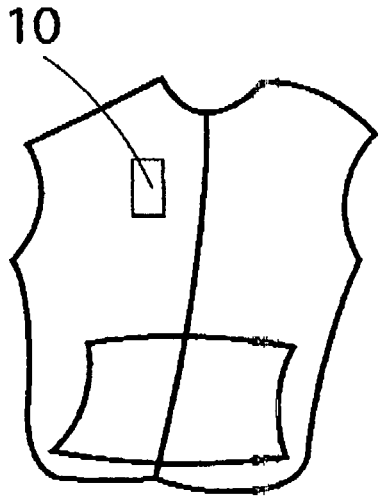
FIG. 7 is the pocket attached to a vest.

Referring to FIGS. 4-7, there is shown several types of garments which the securing pocket can be attached to. Depicted in FIG. 4 is pocket (10) attached to a cap. Depicted in FIG. 5 is pocket (10) attached to a hat. Depicted in FIG. 6 is pocket (10) attached a shirt. Depicted in FIG. 7 is pocket (10) attached to a vest. Additionally, multiple pockets can be attached to one garment as shown in FIG. 6.

Figure 11:
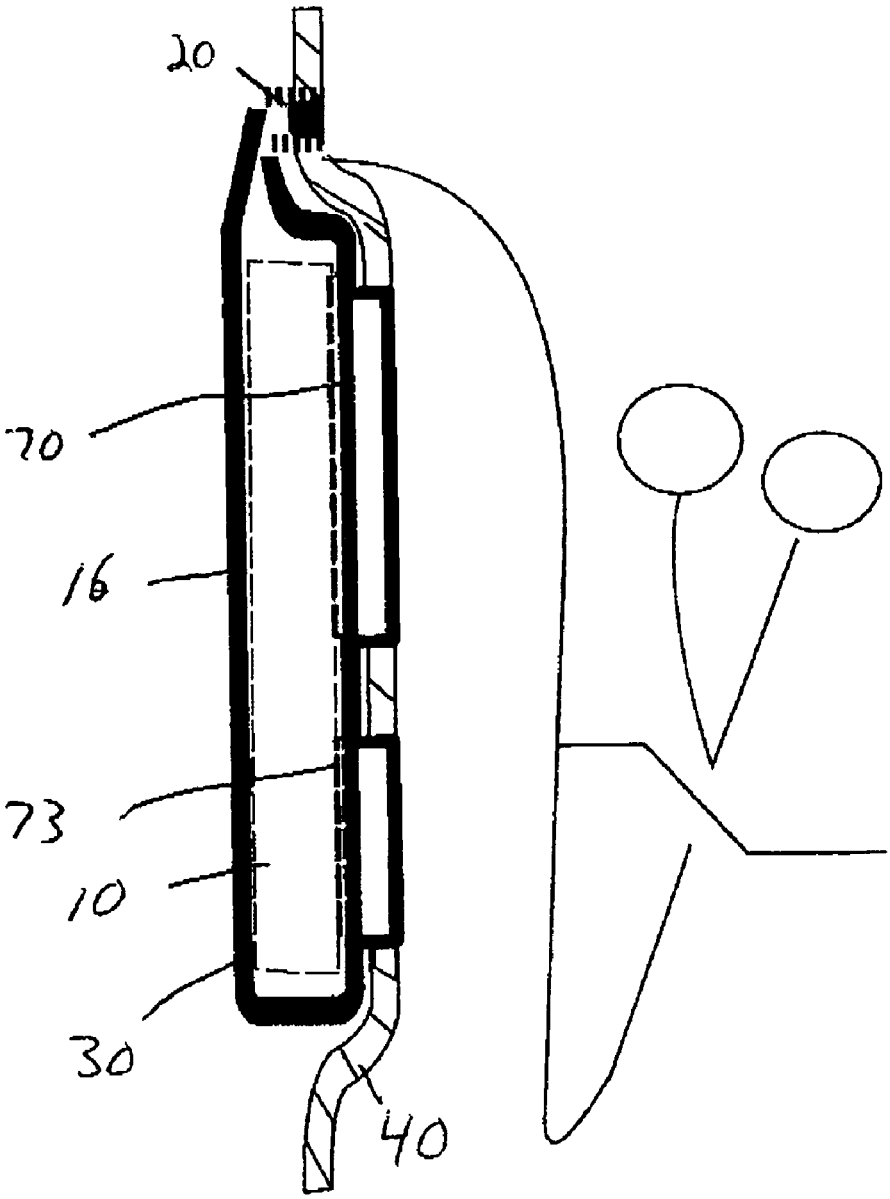
FIG. 11 illustrates a side view of alternative embodiment of pocket 10.

In this alternative embodiment, the cut out supporting window 70, and/or small opening 73, are pierced through the base material 106 into covering1. Then the cut outs supporting 70 and 73 are secured in place. FIG. 10C shows device 10 within pocket container 107. FIG. 11 illustrates a side view of alternative embodiment of pocket 10.

What is claimed is:

1. A securing pocket attached to a body garment for supporting small hands free electronic device, the pocket comprising: first and second pocket panels having bottom and sides edges that are seamlessly attached together defining a pocket cavity with a top edge being unattached;

wherein the second pocket panels includes at least one transparent window that extends through at least one cutout opening of a base material of the garment and secured to an inner surface thereof;

the at least one transparent window of the second pocket panel aligns with the at least one cutout opening of the base material of the garment being of similar configuration;

the first pocket panel is positioned toward the body and substantially spaced from the second pocket panel adapted to receive the electronic device from interior of the garment.

2. The securing pocket of claim 1 further comprises a detachable flap positioned along the top edge of the pocket having means for fastening.

3. The securing pocket of claim 2 further comprises the means for fastening including hook and loop material.

4. The securing pocket of claim 1 further comprises the at least one transparent window overlays a video display of the electronic device.

5. The securing pocket of claim 1 further comprises the second pocket panel is made of a mesh type of material.

6. The securing pocket of claim 1 further comprises the at least one transparent window is made of washable plastic.

7. The securing pocket of claim 1 further comprises the second pocket panel includes at least one small opening for supporting a headphone.

* * * * *